United States Patent [19]

Djordjevic

[11] Patent Number: 4,970,827

[45] Date of Patent: Nov. 20, 1990

[54] CABLE WINDOW REGULATOR

[75] Inventor: Nebojsa Djordjevic, Markham, Canada

[73] Assignee: Magna International Inc., Markham, Canada

[21] Appl. No.: 478,754

[22] Filed: Feb. 12, 1990

Related U.S. Application Data

[63] Continuation of Ser. No. 167,019, Mar. 11, 1988, abandoned.

[30] Foreign Application Priority Data

Mar. 18, 1987 [CA] Canada ..... 532,393

[51] Int. Cl.[5] ..... E05F 11/48

[52] U.S. Cl. ..... 49/349; 49/352; 49/358

[58] Field of Search ..... 49/347, 349, 352, 358

[56] References Cited

U.S. PATENT DOCUMENTS

| | | | |
|---|---|---|---|
| 911,701 | 2/1909 | Campbell | 49/358 |
| 3,831,320 | 8/1974 | Dauernheim et al. . | |
| 4,001,971 | 1/1977 | Gobush et al. | 49/352 |
| 4,090,329 | 5/1978 | Rampel . | |
| 4,110,935 | 9/1978 | Sessa | 49/352 |
| 4,170,847 | 10/1979 | Pickles . | |
| 4,191,060 | 3/1980 | Sessa . | |
| 4,199,899 | 4/1980 | Muhling et al. . | |
| 4,211,122 | 7/1980 | Hess et al. . | |
| 4,235,046 | 11/1980 | Hess et al. . | |
| 4,237,656 | 12/1980 | Hess et al. . | |
| 4,367,660 | 1/1983 | Becker et al. . | |
| 4,389,818 | 6/1983 | Sakamoto | 49/349 |
| 4,428,542 | 1/1984 | Kobazashi et al. . | |
| 4,433,508 | 2/1984 | Corletta . | |
| 4,440,354 | 4/1984 | Kobagashi et al. . | |
| 4,480,409 | 11/1984 | Hora . | |
| 4,483,100 | 11/1984 | Blankenburg et al. . | |
| 4,534,233 | 8/1985 | Hamaguchi . | |

FOREIGN PATENT DOCUMENTS

| | | | |
|---|---|---|---|
| 955289 | 9/1974 | Canada . | |
| 2906424 | 8/1979 | Fed. Rep. of Germany . | |
| 2229270 | 12/1974 | France | 49/352 |
| 2022683 | 12/1979 | United Kingdom . | |
| 2029502 | 3/1980 | United Kingdom . | |
| 2029895 | 3/1980 | United Kingdom . | |

*Primary Examiner*—James R. Brittain

*Attorney, Agent, or Firm*—Ivor M. Hughes; Neil H. Hughes

[57] ABSTRACT

A vehicle window regulator is provided for lifting a window and lowering the window for retraction into a window well in a vehicle door. In the best embodiment the window is supported for lifting and lowering by first, second and third flexible cables, each of which is attached at one end to a take-up mechanism mounted on the window. The first and second cables at the end opposite the take-up mechanism are mounted to an upper portion of the body of the vehicle door, and the third cable at the end opposite the take-up mechanism is mounted to a lower portion of the body of the vehicle door. For lifting the window, the take-up mechanism shortens the first and second cables and simultaneously lengthens the third cable. For lowering the window, the operation is reversed. For vehicle windows and doors having an outwardly convex curvature whereby when the window is raised and lowered the take-up mechanism mounted on the window describes an arcuate path, the third flexible cable is pivotally mounted at the point of attachment to the lower portion of the body of the vehicle door so as to permit lateral deflection of the third flexible cable to maintain its alignment with the take-up mechanism, and; pivotal cable guide pulleys for guiding the first and second cables are attached to the lower portion of the window for guiding the first and second cables to maintain alignment with the take-up mechanism.

12 Claims, 6 Drawing Sheets

FIG.5.
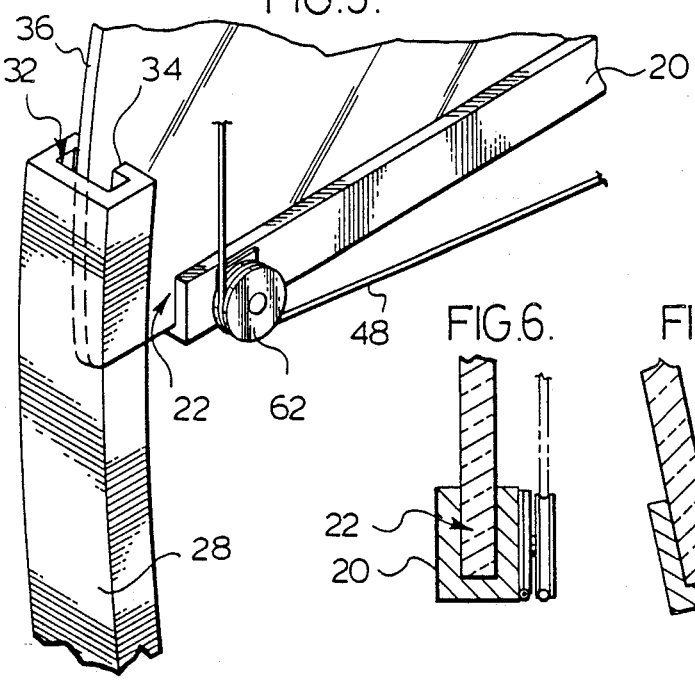
FIG.6.
FIG.7.
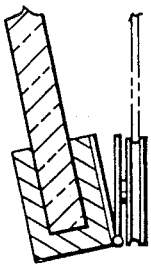
FIG.4.
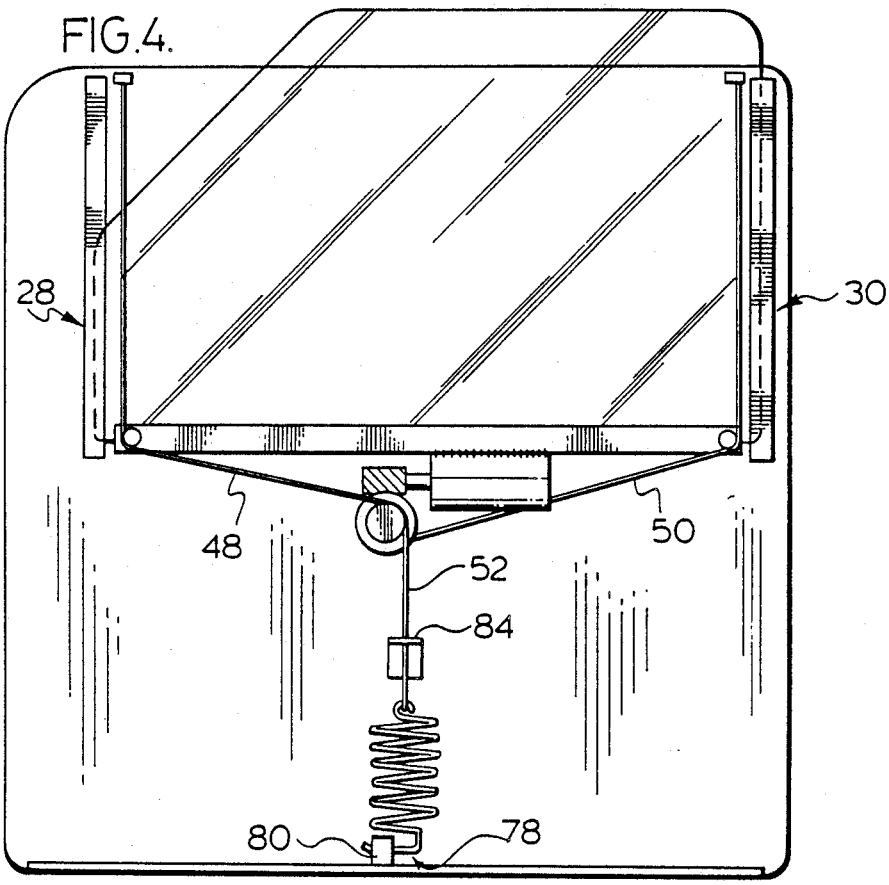

CABLE WINDOW REGULATOR

This application is a continuation of U.S. Ser. No. 07/167,019, filed Mar. 11, 1988, abandoned.

FIELD OF INVENTION

The present invention relates to an improved window regulator employing cables for lifting a window and lowering the window for retraction into a window well in a vehicle door, and a kit of components therefor.

BACKGROUND OF INVENTION

It is desirable when providing means for lifting and lowering a vehicle window, to provide a mechanism which is as simple as possible, thereby providing a mechanism which is inexpensive to produce and mechanically effective. A primary criteria for mechanical effectiveness is that the window start and stop smoothly, without jerking or becoming stuck. Some of the vehicle window regulators which have been disclosed, may be broadly grouped in distinct categories:

A. Rack & Pinion

U.S. Pat. No. 4,389,818 to "Sakamoto" discloses a window regulating mechanism driven by an electric motor which is attached by a bracket to the bottom portion of a vehicle window. The output shaft of the motor drives a pinion (or sprocket), and is generally horizontally oriented. A single flexible plastic strap having teeth (or perforations) for engagement with a pinion or sprocket, is secured to a body panel and extends in a direction corresponding to the direction of movement of the window glass panel (generally vertical). The pinion of the output shaft drivingly engages the teeth of the flexible plastic strap—rotation of the pinion may thereby either lift or lower the window depending upon the direction of rotation of the output shaft.

U.S. Pat. No. 4,170,847 to "Pickles" discloses a window regulating mechanism of the "rack and pinion" type, wherein a vertically movable window at its lower edge is connected to a pair of transmission assemblies which are engageable with a pair of vertically oriented racks. The racks are horizontally spaced apart and each rack is proximate one side of the window. An electric motor attached to the window is movable therewith and has an output shaft having two pinions which synchronously engage the two racks for vertical movement.

B. Bowden Cable Systems

Many mechanisms have been disclosed in which bowden cables transfer tension or compression to move a window along a guide. Generally the drive means is stationary and moves a cable threaded inside a sheath to transmit tension and compression. The end of the cable may be attached to a shoe which is fixed to a window. Usually the shoe is guided by a single track for vertically lifting and lowering the window. Examples of "bowden cable" mechanisms may be seen in U.S. Pat. No. 4,483,100; 4,367,660; 4,211,122; 4,433,508; 3,831,320; 4,090,329; 4,199,899 and 4,237,656.

C. Closed Loop Cable Systems

Closed loop cable systems generally provided for the circulation of a cable by engaging the cable with a rotatable drum. A portion of the cable extends in a direction generally corresponding to the intended direction of movement for lifting and lowering the window. Usually a fitting is clasped to the cable and is guided for movement by a single track. The fitting is attached to the bottom of the window. Circulation of the cable may thereby either lift or lower the window depending upon the direction in which the cable is being circulated. Examples of such an arrangement may be seen in United Kingdom Patents Nos. 2,029,895; 2,022,683 and 2,029,502; and in U.S. Pat. Nos. 4,235,046; 4,480,409; 4,534,233; 4,110,935 and 4,440,354. In each of the foregoing examples a single track is employed as a means for guiding the fitting attached to the cable entraining the window for lifting and lowering. The art specifically addresses the problem of properly tensioning the cable so as to provide for a smooth transfer of force to the window. For example U.K. Patent No. 2,029,895 discloses a cable in a circulating loop wherein opposite ends of the cable are each connected by springs to a fitting joining the opposite ends in a loop so as to keep the cable constantly stretched. Other patents disclose a drum for engaging and winding a cable, wherein the drum has resilient biasing means or the like for maintaining tension in the cable and removing slack therefrom—for example U.S. Pat. Nos. 4,191,060 and 4,428,542; and, Canadian Patent No. 955,289.

D. Open Cable Systems

Open cable systems generally have a drum mounted on a door panel for engaging a cable. At least one end of the cable is attached by a fitting to the bottom portion of a window. A portion of the cable may pass over pulley guide means spaced above the bottom of the window thereby providing a mechanical advantage for lifting and lowering the window. For example U.S. Pat. No. 4,001,971 discloses a pair of cables engaging a rotatable drum mounted on a door panel. Each cable is attached at one end to a mount on the bottom of the window, at one side thereof; each cable passes over a first pulley supported vertically above each mount on the bottom of the window; each cable winds around the drum and passes under a pulley mounted proximate the floor of the door panel and horizontally opposite the first pulley; the said opposite end of each cable is attached to the underside of a mount on the bottom of the window. Accordingly, shortening the cable on one side will cause the opposite side of the cable to lengthen. The two cables allow for lifting both sides of the window. Each one of a pair of vertically extending horizontally spaced apart rods passes through a hole in one of the pair of window mounts for guiding the lateral movement of the window.

In another example German Patent No. 2,906,424 discloses a cable window regulator having a torsion winding mechanism. A pair of cables are each, at one end, wound onto drums at the opposite ends of a rod. The rod is housed coaxially in a sheath and engages the sheath housing by torsional springs for resilently biasing the cables.

It is therefore an object of the invention to provide an improved cable window regulator that is simple, effective and economical.

It is a further object of this invention to provide a cable window regulator having improved drive means for uniformly distributing the load when lifting and lowering a vehicle window and which starts and stops smoothly without jerking.

It is a further object of this invention to provide cable drive means suitable for lifting and lowering a vehicle window having a convex curvature.

Further and other objects of the invention will be apparent to those skilled in the art from the following Summary of Invention and detailed description thereof.

SUMMARY OF INVENTION

According to one aspect of the invention there is provided an improved vehicle window regulator for lifting a window and lowering the window for retraction into a window well in a vehicle door, comprising: (a) a vehicle window having a top, bottom and oppositely spaced sides, the window retractable into a well in a vehicle door; (b) at least one mounting means secured to the bottom portion of the window, the at least one mounting means suitable for supporting one take up mechanism intermediate the sides of the window and suitable for supporting two oppositely spaced cable guide means, one of the two cable guide means proximate each side of the window; (c) the take up mechanism supported by (for example mounted on) the window mounting means intermediate the sides of the window, and the two oppositely spaced cable guide means mounted on the window mounting means, one of the two cable guide means mounted proximate the bottom of the window at one side, the other of the two cable guide means mounted proximate the bottom of the window on the opposite side; (d) a first flexible cable and a second flexible cable, one end of each cable attached to the door proximate the top thereof, the two cables attached to the door at substantially horizontally spaced points, each cable supported for sliding movement on one of the two oppositely spaced cable guide means; and, the opposite end of each cable suitably attached to the take up mechanism whereby rotation of the take up mechanism in one direction will lengthen both the first flexible cable and the second flexible cable and rotation of the take up mechanism in the opposite direction will shorten both the first flexible cable and the second flexible cable; (e) a third flexible cable, one end of the third flexible cable attached to the vehicle body at a point spaced below the bottom of the window, the opposite end of the third flexible cable suitably attached to the take up mechanism whereby when rotation of the take up mechanism lengthens both the first and second flexible cables the third flexible cable is shortened, and whereby when rotation of the take up mechanism shortens both the first and second flexible cables the third flexible cable is lengthened; (f) drive means for enabling clockwise and counterclockwise rotation of the take up mechanism.

According to this aspect of the invention shortening both the first cable and second cable raises the window, while the third cable is concurrently lengthened; lengthening both the first cable and second cable concurrent with shortening the third cable, lowers the window.

According to one embodiment of the invention the take up mechanism may comprise a gear mechanism, for example a worm gear concentric therewith, and the drive means comprises an electric motor attached to the window mounting means, the electric motor having gearing, for example a worm attached to its output shaft, for engaging the worm gear whereby the axial rotation of the output shaft causes the worm gear to rotate the take up mechanism.

According to another aspect of the invention the take up mechanism may comprise a pulley for frictionally engaging a flexible cable suitable for movement relative to the take up mechanism whereby movement of the frictionally engaging cable causes the engaged pulley of the take up mechanism to rotate. Preferably the frictionally engaging cable comprises a continuous loop supported for circulation by at least two (and preferably three) spaced apart cable guide means, for example sheaves or pulleys attached to a wall of the window well, the at least two cable guide pulleys attached to the door at two vertically spaced apart points comprising a line extending in a direction corresponding to the direction of movement of the window, the at least two guide pulleys spaced intermediate the sides of the window. At least one of the spaced apart cable guide means is suitable to frictionally engage the cable and is operable by (for example connected to) a hand crank whereby rotation of the hand crank circulates the cable in a continuous loop. In a preferred embodiment of the invention the cable is supported for circulation by three cable guide means spaced apart in a tri-angular configuration.

According to another aspect of the invention the improved vehicle window regulator is suitable for lifting and lowering a window having an outwardly convex plane of curvature corresponding to the outwardly convex plane of curvature of an automobile door, whereby when the window is raised and lowered it follows an arcuate path corresponding to the outwardly convex plane of curvature of the automobile door. According to this aspect of the invention the third flexible cable at its end remote the take up reel is pivotally attached to the bottom of the vehicle window well to permit the lateral deflection of the third cable when the window is raised and lowered.

According to another aspect of the invention wherein the window has an outwardly convex plane of curvature, the two oppositely spaced cable guide pulleys attached on the window mount are pivotally mounted thereon to permit the lateral deflection of each cable guide pulley in alignment with the lateral deflection of the first cable and the second cable when the window is raised and lowered.

According to a preferred embodiment of the invention suitable for a window having an outwardly convex plane of curvature, the end of the third flexible cable opposite the end which is attached to the take up mechanism is attached to any resilient biasing means that can expand and maintain tension, for example a spring or a piece of rubber, which is attached to the vehicle body at a point on the vehicle body spaced below the bottom of the window. According to this embodiment of the invention, the resilient biasing means is normally under tension when the window is completely lowered and when the window is completely raised, and is further extensible from the normally tense position, whereby when the window is raised to the position intermediate the completely lowered and the completely raised position providing the maximum extent of lateral deflection, the resilient biasing means extends sufficiently to increase the length of the third cable whereby the sum of (i) the length of the first and second cables in parallel one to the other, plus (ii) the length of the third flexible cable, is greater than the sum of the length of the said cables when the window is completely lowered or completely raised. Thus, if the reader forms a triangle viewed from one or either end of the door, the triangle comprising: point (a) comprising two parallel points of attachment, of the first and second cables parallel one to the other, to the door proximate the top thereof; point (b) comprising a mutual point of attachment of the first, second and third cables substantially comprising a point proximate the take-up mechanism mounted on the window mounting means secured to the bottom portion of the window, and; point (c) comprising a point of attachment of the third flexible cable to the vehicle body at a point spaced substantially vertically below point (a) below the bottom of the window; it will be apparent that the sum of the distance equal to the distance between points (a) and (b) plus points (b) and (c) will be greater than the distance between points (a) and (c) when the arcuate path of the window brings the base of the window to the intermediate position of maximum lateral deflection from the substantially vertical line between points (a) and (c)—according to the formula for a triangle.

According to another aspect of the invention there is provided a kit of components for a vehicle window regulator. The kit of components comprising: (a) a take up mechanism for taking up and letting out three cables, two cables for being taken up to be shortened simultaneously and let out to be lengthened simultaneously for raising and lowering a window and the third cable for being let out and taken up as the two cables are taken up and let out respectively; (b) mounting means for mounting the kit on a vehicle window; (c) drive means for driving the take up mechanism, and; (d) support means for permitting the cables to slide and be secured. Preferably the kit of components comprises the extensible resilient biasing means.

The invention will now be illustrated with reference to the following drawings and description of an embodiment of the invention.

DESCRIPTION OF DRAWINGS

FIG. 4 is a side view of the window regulator in FIG. 1, retracted into the window well of a door.

FIG. 5 is a close-up perspective view of a window guide channel, and a cable guide pulley mounted on the window in FIGS. 1, 3, 4, 8, 9 and 10.

FIG. 6 is a close-up end view of the cable guide pulley in FIG. 5, shown when the window is retracted into the window well in the door.

FIG. 7 is a close-up end view of the cable guide pulley in FIG. 5 deflected laterally and shown when the window is in a raised position.

DETAILED DESCRIPTION OF EMBODIMENTS OF THE INVENTION

Figure 1:
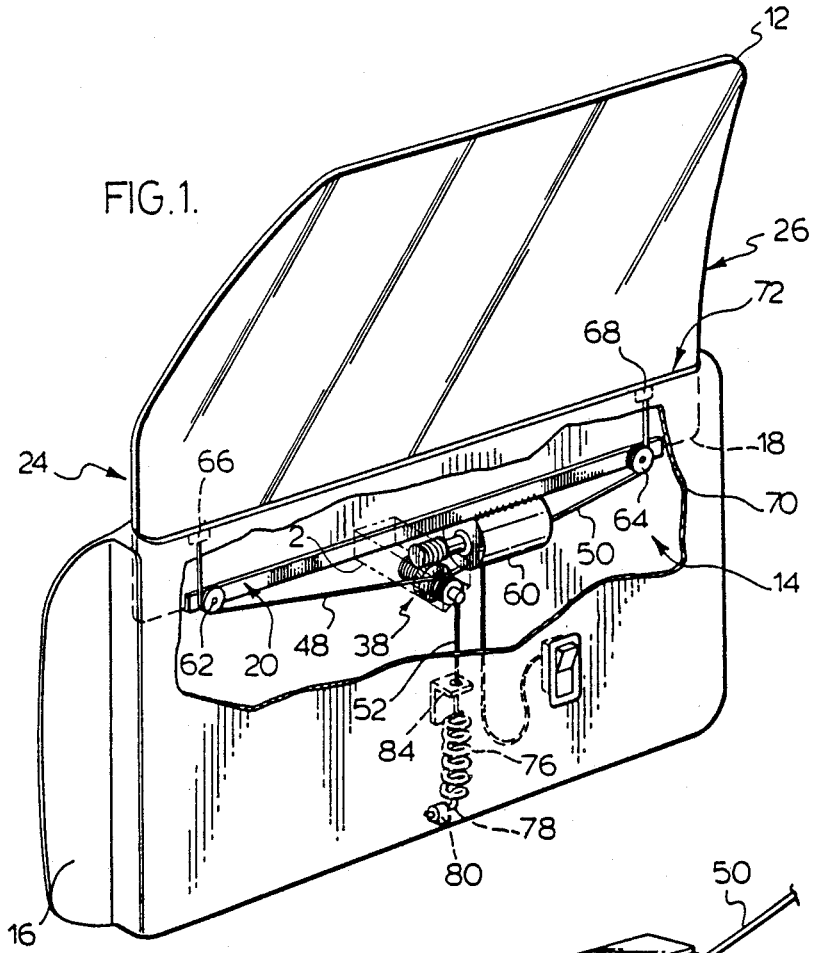
FIG. 1 is a perspective view of a vehicle window regulator in a window well of a vehicle door.
Figure 3:
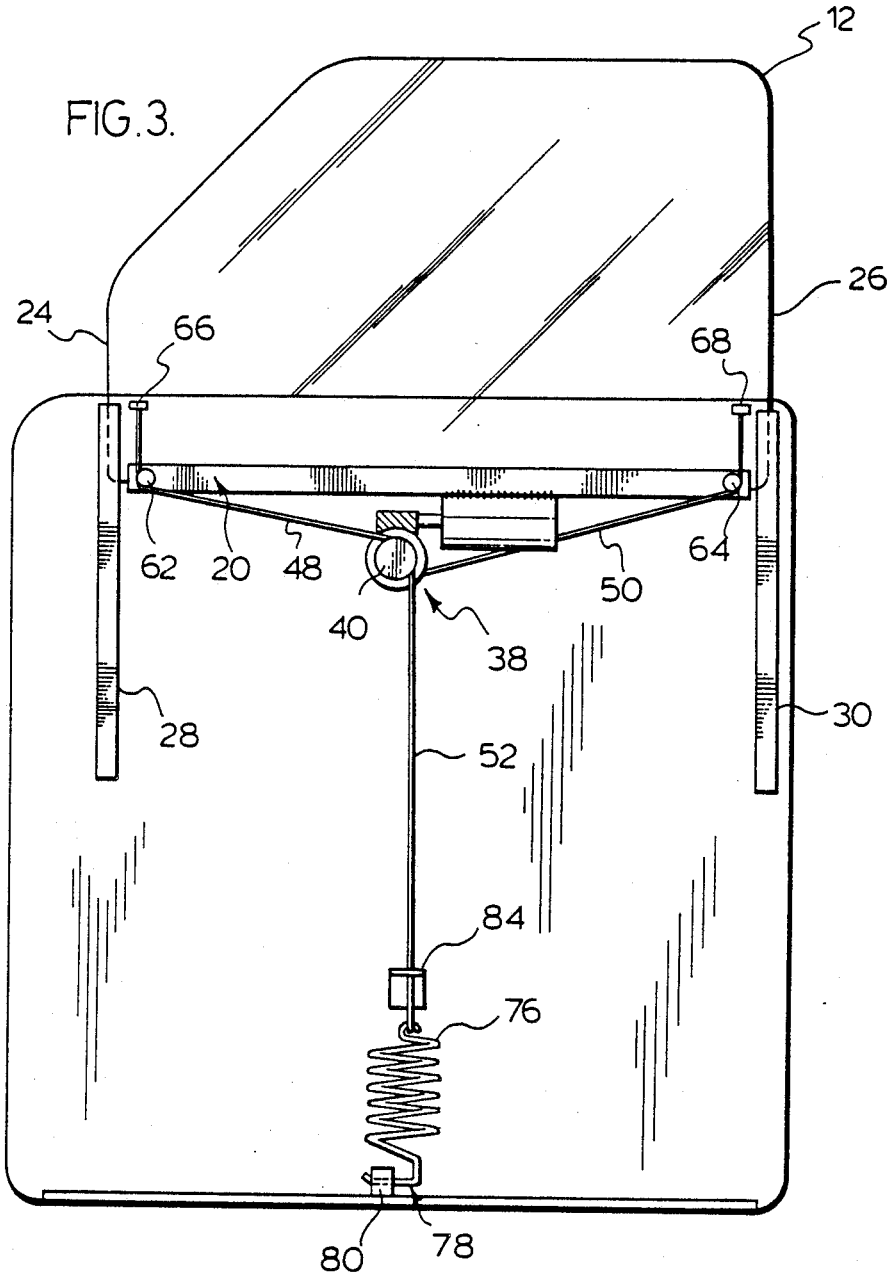
FIG. 3 is a side view of the window regulator in FIG. 1 with the window in a raised position.

Referring to FIGS. 1 and 3, there is shown a vehicle window regulator for lifting a window 12 and lowering the window 12 for retraction into a window well 14 in a vehicle door 16. The bottom 18 of the window 12 is secured to a mount 20, the mount 20 preferably comprising a longitudinally extending "U-shaped" channel 22 (best seen in FIGS. 5, 8 and 9). The sides 24,26 of the window 12 are guided for vertical movement when the window is raised and lowered by two horizontally spaced vertical guide channels 28,30. In one embodiment shown in FIG. 5, each guide channel 28,30 comprises a longitudinally extending grove 32 of a "C-shaped" cross section having a longitudinally extending opening 34 slightly greater than the thickness 36 of the window glass.

Figure 2:
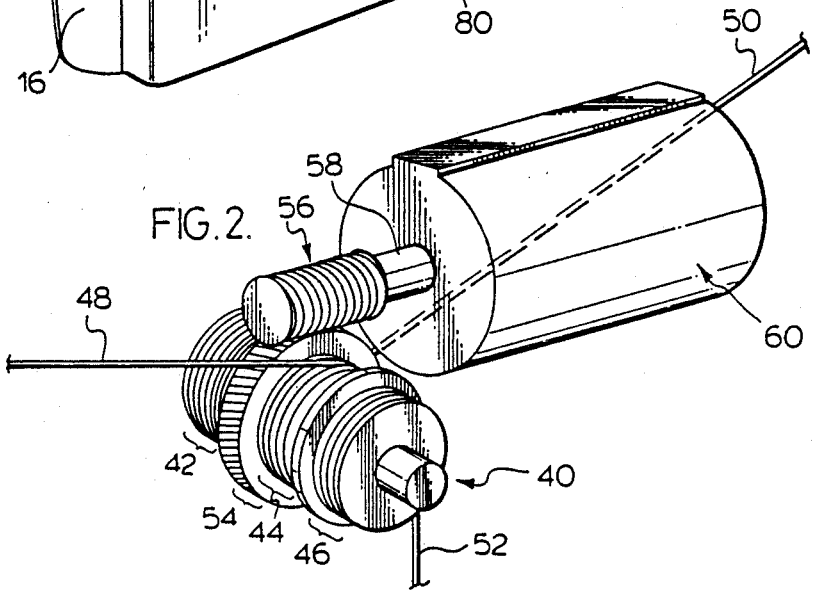
FIG. 2 is a close up view of part of the structure shown in FIG. 1 comprising the take up reel having a worm gear rotatable by a worm attached to the output shaft of an electric motor.

Referring generally to FIGS. 1, 2 and 3, a cable drive assembly 38 enables force to be transmitted to the window mount 20 for lifting and lowering the window 12. A take up reel 40 is secured to the window mount 20 intermediate the sides 24,26 of the window 12, and is vertically movable with the window 12 when it is raised and lowered. In one embodiment (shown in detail in FIG. 2) the take up reel 40 has three sections 44,42,46, each sector for take up of one of a first 48, second 50, and third 52 cable. The take up reel 40 preferably has a worm gear 54 concentric therewith. In the embodiment shown in FIGS. 1, 2, 3, 4, 8 and 9, the worm gear 54 is rotatable by gearing, preferably a worm 56 attached to the output shaft 58 of an electric motor 60. Two cable guide pulleys 62,64 are attached to the window mount 20 proximate the sides 24,26 of the window 12. The first flexible cable 48 and the second flexible cable 50 are each attached at one end 66,68 (respectively) to the interior wall 70 of the vehicle door 16 proximate the mouth 72 of the window well 14. The points of attachment 66,68 of the first 48 and second 50 flexible cables are horizontally spaced apart proximate the opposite ends of the window well mouth 72. The first 48 and second 58 cables are each supported for sliding movement by one of the cable guide pulleys 62 and 64, respectively. The opposite end of each of the first 48 and second 50 flexible cables is wound onto an appropriate sector 44 and 42 (respectively) of the take up reel 40. The cables 48,50 are oppositely wound, whereby rotation of the take up reel 40 in one direction will lengthen both cables 48,50 and rotation in the opposite direction will shorten both cables 48,50.

A third flexible cable 52 is attached at one end to the bottom of the vehicle door 16 preferably via a pivotally mounted spring 76. A piece of rubber (not shown) may be used in lieu of the springs 76—all that is necessary is that the spring, rubber piece or any other suitable means be expandable and capable of maintaining tension. In one embodiment (shown in FIGS. 1, 3, 4, 8, 9 and 10) the pivotally mounted spring 76 at one end for anchoring proximate the bottom of the vehicle door 16 has a shaft 78 for coupling with a cylindrical bore 74 (best is as an end view in FIGS. 8 and 9 having the shaft 78 inserted in the bore 74) in an attachment bracket 80. The axis of the bore 74 is parallel to the length of the door 16 such that the shaft 78 will rotate in the bore 74 in a direction corresponding with the lateral deflection of the spring 76 from proximate the interior wall 70 to proximate the exterior wall 82 of the window well 14, thereby permitting the spring 76 to pivot when the window is raised and lowered (best seen in FIGS. 8 and 9). The third flexible cable 52 at its opposite end is wound into an appropriate sector 46 of the take up reel. The third flexible cable 52 is wound in an appropriate direction whereby when rotation of the take up reel 40 lengthens the first and second cables 48,50 the third cable 52 is shortened (best seen in FIGS. 4 and 9), and whereby rotation of the take up reel 40 in the opposite direction lengthens the third cable 52 synchronous with the shortening of the first and second cables 48,50 (best seen in FIGS. 3 and 8).

In the cable drive assembly 38 shown, the spring 76 normally draws into tension the first, second and third cables 48,50,52. The tension eliminates any slack in the cables 48,50,52 and thereby provides for the smooth take up and play out of the cables 48,50,52 for raising and lowering the window 12, without jerking or binding when the cable drive assembly 38 starts and stops. It will be appreciated by those skilled in the art that all that is necessary is that there be provided resilient biasing means for normally drawing the first, second and third cables into tension. For example, in an alternative embodiment the cable drive assembly 38 might provide a torsional spring for normally winding the first, second and third cables 48, 50, 52 onto the appropriate sector of the take up reel.

Figure 8:
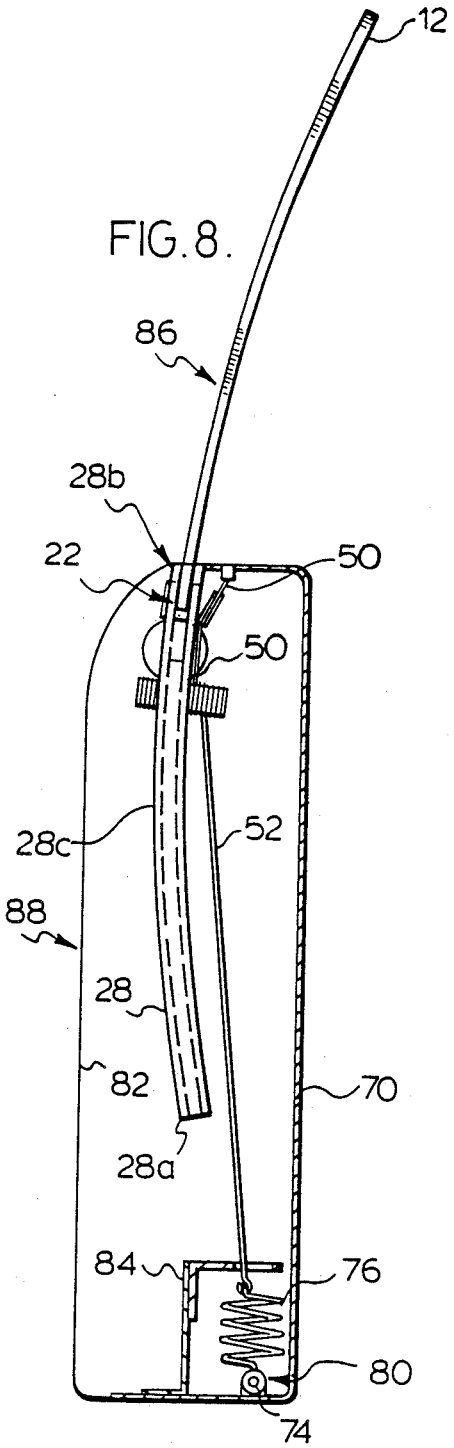
FIG. 8 is an end view of the window in the raised position shown in FIG. 3.
Figure 9:
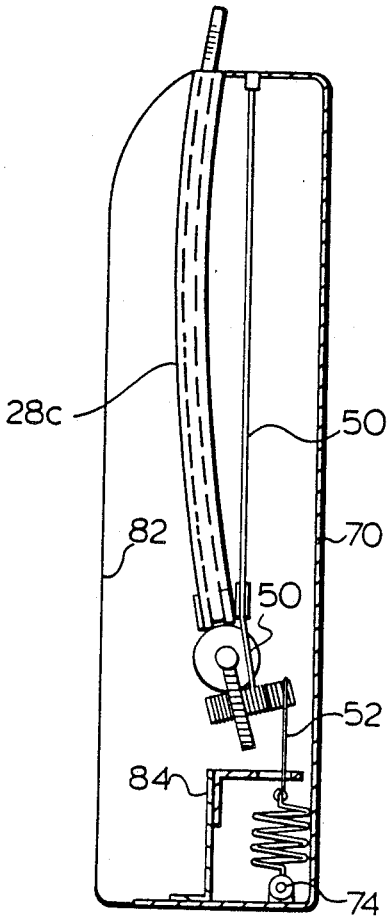
FIG. 9 is an end view of the window shown in FIG. 4, shown retracted into the window well of a door.

With reference to FIGS. 8 and 9, aerodynamically efficient automobile body styling normally requires a window 12 having a convex curvature 86 relative to the exterior 88 of the vehicle. The present cable drive assembly 38 is capable of pivotally maintaining the alignment of the third cable 52 with the take up reel 40 and pivotally maintains the alignment of the first and second cables 48,50 intermediate the attachment points 66, 68 and the cable guide pulleys 62,64, respectively.

Each vertical guide channel 28,30 has a convex curvature congruent with that of the window. Referring to FIGS. 8 and 9, the bottom portion **28*a* of the vertical guide channel 28 is closer to the interior wall 70 of the door 16 than the top portion 28*b*—the mid-point 28*c* of the guide channel is farthest from the interior wall 70. Accordingly, when the window 12 is raised and lowered the bottom 18 of the window 12 proximate the mount 20 describes an arcuate path. The lateral distance of the take up reel 40 from the spring attachment bracket 80 and the cable attachment points 66, 68 is greatest when the window mount 20 is positioned proximate the mid-point 28*c* of the guide channels 28,30. Similarly, the lateral distance of the cable guide pulleys 62, 64 from the attachment points 66,68, respectively, is greatest at the mid-point 28*c*. Accordingly each cable guide pulley 62,64 is pivotally mounted on the window mount 20 to permit the plane of each pulley 62,64 which is perpendicular to the axis of rotation to maintain alignment with the attachment points 66, 68**, respectively.

Figure 8A:
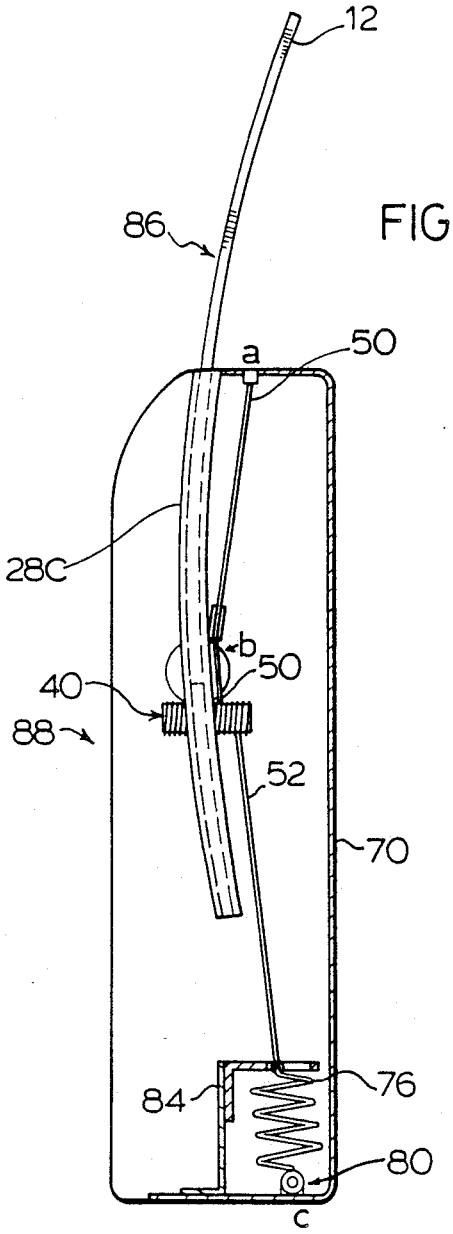
FIG. 8A is an end view of the window shown in FIGS. 8 and 9, in an intermediate position.

With reference to the end view of the window 12 and door 88 seen in FIGS. 8 and 9, it will be appreciated that schematically a triangle is formed when three lines are drawn: (a) from the take up reel 40 to the spring attachment bracket 80, (b) from the spring attachment bracket 80 to the cable attachment points 66, 88, and (c) from the cable attachment points 66, 88 to the take up reel 40. The shortest distance between the cable attachment points 66, 88 and the spring attachment bracket 80 is achieved by a substantially vertical line therebetween, as when the window is in a fully raised position in FIG. 8 and a fully lowered position in FIG. 9. When the window 12 is in the intermediate position **28*c* (best seen in FIG. 8A) the first and second cables 48, 50 in parallel one to the other, and the third cable 52 are laterally deflected away from the substantially vertical line comprising the shortest distance between the points of attachment 66, 68 and the spring attachment . bracket 80. Accordingly when the window is in the intermediate position 28*c*, the spring 76*a* expands as seen in FIG. 8A thereby increasing the length of the third flexible cable 52 compensating for the increased length of cable required in the intermediate position 28*c***.

Preferably a plate 84 is provided to limit the maximum expansion of the spring **76*a***.

Figure 10:
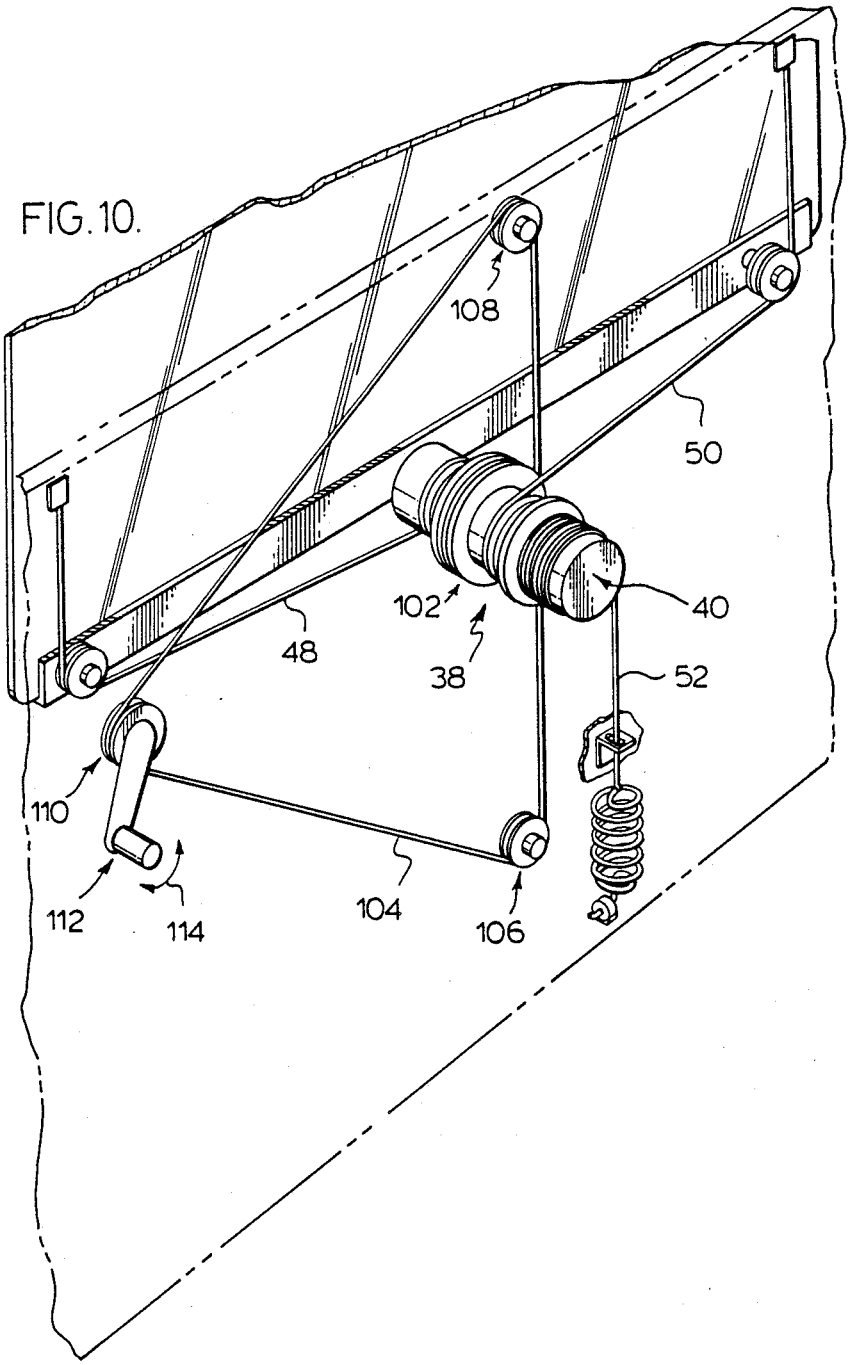
FIG. 10 is a perspective view of an embodiment of the vehicle window regulator in FIG. 1, adapted to be driven by hand.

With reference to FIG. 10 there is shown a vehicle window regulator having a cable drive assembly 38 adapted to be driven by hand. The take up reel 40 comprises a pulley 102 for frictionally engaging a flexible cable arranged in a continuous loop 104. The flexible cable 104 is supported for circulation by at least two and preferably three pulleys 106, 108, 110. One of the support pulleys 110 frictionally engages the flexible cable 104 and is connected to a hand crank 112, whereby rotation of the hand crank in a clockwise or counter-clockwise direction 114 circulates the cable 104, causing the take up reel 40 to rotate in a clockwise or counter-clockwise direction, respectively. Applicant therefore has included in FIG. 1 a rectangular box structure 2 to connect the pulley therein with the window mount 20.

As many changes can be made to the embodiment of the invention without departing from the scope of the invention, it is intended that all material be considered as illustrative of the invention and not in a limiting sense.

The embodiments of the invention in which an exclusive property or privilege is claimed are as follows:

1. A vehicle window regulator for lifting a window and lowering the window for retraction into a window well in a vehicle door, comprising:

(a) a vehicle window having a top, bottom and oppositely spaced sides, the window retractable into a well in a vehicle door;

(b) at least one mounting means secured to the bottom portion of the window, the at least one mounting means suitable for supporting one take up mechanism intermediate the sides of the window and suitable for supporting two oppositely spaced cable guide means, one of the two cable guide means proximate each side of the window;

(c) the take up mechanism supported by the window mounting means intermediate the sides of the window, and the two oppositely spaced cable guide means mounted on the window mounting means, one of the two cable guide means mounted proximate the bottom of the window at one side, the other of the two cable guide means mounted proximate the bottom of the window on the opposite side;

(d) a first flexible cable and a second flexible cable, one end of each cable attached to the door proximate the top thereof, the two cables attached to the door at substantially horizontally spaced points, each cable supported for sliding movement on one of the two oppositely spaced cable guide means; and, the opposite end of each cable suitably attached to the take up mechanism whereby rotation of the take up mechanism in one direction will lengthen both the first flexible cable and the second flexible cable and rotation of the take up mechanism in the opposite direction will shorten both the first flexible cable and the second flexible cable;

(e) a third flexible cable, one end of the third flexible cable attached to the vehicle body at a point spaced below the bottom of the window, the opposite end of the third flexible cable suitably attached to the take up mechanism whereby when rotation of the take up mechanism lengthens both the first and second flexible cables the third flexible cable is shortened, and whereby when rotation of the take up mechanism shortens both the first and second flexible cables the third flexible cable is lengthened;

(f) drive means for enabling clockwise and counterclockwise rotation of the take up mechanism wherein the take up mechanism comprises a gear mechanism and the drive means comprises an electric motor attached to the window mounting means, the electric motor having a gear mechanism attached to its output shaft for engaging the gear mechanism of the take up mechanism whereby the axial rotation of the output shaft causes the take up mechanism to rotate.

2. The window regulator of claim 1 wherein the take up mechanism comprises a worm gear concentric therewith and the electric motor has a worm attached to its output shaft for engaging the worm gear whereby the axial rotation of the output shaft causes the worm gear to rotate the take up mechanism.

3. The window regulator of claim 1 wherein in use the first flexible cable, the second flexible cable, and the third flexible cable are normally drawn into tension by resilient biasing means attached proximate the door for the first and second flexible cable, and attached proximate the vehicle body for the third flexible cable.

4. The window regulator of claim 1 wherein the window regulator is suitable for a window having an outwardly convex plane of curvature, whereby the end of the third flexible cable opposite the end which is attached to the take up mechanism is attached to an expandable resilient biasing means which is attached to the vehicle body at a point on the vehicle body spaced below the bottom of the window, whereby the expandable resilient biasing means is normally under tension when the window is completely lowered and when the window is completely raised and is further extensible from the normally tense position, whereby when the window is raised to the position intermediate the completely lowered and the completely raised positions providing the maximum extent of lateral deflection, the expandable resilient biasing means extends sufficiently to increase the length of the third cable to permit the lateral deflection.

5. The window regulator of claim 1 wherein the third flexible cable in use deflects towards and away from the door and is pivotally attached at its end remote the take up mechanism to the bottom of the vehicle window well to facilitate the deflection of the third cable towards and away from the door when the window is raised and lowered.

6. The window regulator of claim 1 wherein in use the first and second cable deflects towards and away from the door and the two oppositely spaced cable guide means deflect towards and away from the door and are attached on the window mount and pivotally mounted thereon to facilitate the lateral deflection of each cable guide means towards and away from the door in alignment with the lateral deflection of the first cable and the second cable towards and away from the door when the window is raised and lowered.

7. A vehicle window regulator for lifting a window and lowering the window for retraction into a window well in a vehicle door, comprising:

(a) a vehicle window having a top, bottom and oppositely spaced sides, the window retractable into a well in a vehicle door;

(b) at least one mounting means secured to the bottom portion of the window, the at least one mounting means suitable for supporting one take up mechanism intermediate the sides of the window and suitable for supporting two oppositely spaced cable guide means, one of the two cable guide means proximate each side of the window;

(c) the take up mechanism supported by the window mounting means intermediate the sides of the window, and the two oppositely spaced cable guide means mounted on the window mounting means, one of the two cable guide means mounted proximate the bottom of the window at one side, the other of the two cable guide means mounted proximate the bottom of the window on the opposite side;

(d) a first flexible cable and a second flexible cable, one end of each cable attached to the door proximate the top thereof, the two cables attached to the door at substantially horizontally spaced points, each cable supported for sliding movement on one of the two oppositely spaced cable guide means; and, the opposite end of each cable suitably attached to the take up mechanism whereby rotation of the take up mechanism in one direction will lengthen both the first flexible cable and the second flexible cable and rotation of the take up mechanism in the opposite direction will shorten both the first flexible cable and the second flexible cable;

(e) a third flexible cable, one end of the third flexible cable attached to expandable resilient biasing means normally under tension, the expandable resilient biasing means attached to the vehicle body at a point spaced below the bottom of the window, the opposite end of the third flexible cable suitably attached to the take up mechanism whereby when rotation of the take up mechanism lengthens both the first and second flexible cables the third flexible cable is shortened, and whereby when rotation of the take up mechanism shortens both the first and second flexible cables the third flexible cable is lengthened;

(f) drive means for enabling clockwise and counterclockwise rotation of the take up mechanism.

8. The window regulator of claim 7 wherein the take up mechanism comprises a gear mechanism and the drive means comprises an electric motor attached to the window mounting means, the electric motor having a gear mechanism attached to its output shaft for engaging the gear mechanism of the take up mechanism whereby the axial rotation of the output shaft causes the take up mechanism to rotate.

9. The window regulator of claim 7 wherein the take up mechanism comprises a pulley for frictionally engaging a flexible cable suitable for movement relative to the take up mechanism whereby movement of the frictionally engaging cable causes the engaged pulley of the take up mechanism to rotate.

10. A vehicle window regulator for lifting a window and lowering the window for retraction into a window well in a vehicle door, comprising:

(a) a vehicle window having a top, bottom and oppositely spaced sides, the window retractable into a well in a vehicle door;

(b) at least one mounting means secured to the bottom portion of the window, the at least one mounting means suitable for supporting one take up mechanism intermediate the sides of the window and suitable for supporting two oppositely spaced cable guide means, one of the two cable guide means proximate each side of the window;

(c) the take up mechanism supported by the window mounting means intermediate the sides of the window, and the two oppositely spaced cable guide means mounted on the window mounting means, one of the two cable guide means mounted proximate the bottom of the window at one side, the other of the two cable guide means mounted proximate the bottom of the window on the opposite side;

(d) a first flexible cable and a second flexible cable, one end of each cable attached to the door proximate the top thereof, the two cables attached to the door at substantially horizontally spaced points, each cable supported for sliding movement on one of the two oppositely spaced cable guide means; and, the opposite end of each cable suitably attached to the take up mechanism whereby rotation of the take up mechanism in one direction will lengthen both the first flexible cable and the second flexible cable and rotation of the take up mechanism in the opposite direction will shorten both the first flexible cable and the second flexible cable;

(e) a third flexible cable, one end of the third flexible cable attached to the vehicle body at a point spaced below the bottom of the window, the opposite end of the third flexible cable suitably attached to the take up mechanism whereby when rotation of the take up mechanism lengthens both the first and second flexible cables the third flexible cable is shortened, and whereby when rotation of the take up mechanism shortens both the first and second flexible cables the third flexible cable is lengthened;

(f) drive means for enabling clockwise and counterclockwise rotation of the take up mechanism wherein the take up mechanism comprises a pulley for frictionally engaging a flexible cable suitable for movement relative to the take up mechanism whereby movement of the frictionally engaging cable causes the engaged pulley of the take up mechanism to rotate, having a frictionally engaging cable wherein the frictionally engaging cable further comprises a continuous loop supported for circulation by at least two spaced apart cable guide members attached to a wall of the window well, the at least two cable guide members attached to a wall of the window well at two vertically spaced apart points comprising a line extending in a direction corresponding to the direction of movement of the window, at least one of said at least two spaced apart cable guide members suitable to frictionally engage said frictionally engaging cable and a hand crank for rotating the frictionally engaging cable whereby rotation of the hand crank circulates the cable in a continuous loop.

11. A vehicle window regulator for lifting a window and lowering the window for retraction into a window well in a vehicle door, comprising:

(a) a vehicle window having a top, bottom and oppositely spaced sides, the window retractable into a well in a vehicle door;

(b) at least one mounting means secured to the bottom portion of the window, the at least one mounting means suitable for supporting one take up mechanism intermediate the sides of the window and suitable for supporting two oppositely spaced cable guide means, one of the two cable guide means proximate each side of the window;

(c) the take up mechanism supported by the window mounting means intermediate the sides of the window, and the two oppositely spaced cable guide means mounted on the window mounting means, one of the two cable guide means mounted proximate the bottom of the window at one side, the other of the two cable guide means mounted proximate the bottom of the window on the opposite side;

(d) a first flexible cable and a second flexible cable, one end of each cable attached to the door proximate the top thereof, the two cables attached to the door at substantially horizontally spaced points, each cable supported for sliding movement on one of the two oppositely spaced cable guide means; and, the opposite end of each cable suitably attached to the take up mechanism whereby rotation of the take up mechanism in one direction will lengthen both the first flexible cable and the second flexible cable and rotation of the take up mechanism in the opposite direction will shorten both the first flexible cable and the second flexible cable;

(e) a third flexible cable, one end of the third flexible cable attached to the vehicle body at a point spaced below the bottom of the window, the opposite end of the third flexible cable suitably attached to the take up mechanism whereby when rotation of the take up mechanism lengthens both the first and second flexible cables the third flexible cable is shortened, and whereby when rotation of the take up mechanism shortens both the first and second flexible cables the third flexible cable is lengthened;

(f) drive means for enabling clockwise and counterclockwise rotation of the take up mechanism wherein the take up mechanism comprises a pulley for frictionally engaging a flexible cable suitable for movement relative to the take up mechanism whereby movement of the frictionally engaging cable causes the engaged pulley of the take up mechanism to rotate having a frictionally engaging cable wherein the frictionally engaging cable further comprises a continuous loop supported for circulation by at least three spaced apart cable guide members attached to a wall of the window well, at least two of the at least three cable guide members attached to a wall of the window well at two vertically spaced apart points comprising a line extending in a direction corresponding to the direction of movement of the window, one of said at least three spaced apart cable guide members spaced laterally to one side of a line joining the at least two cable guide members attached to the wall of the window well at two vertically spaced apart points whereby the continuous loop is supported for circulation by the at least three cable guide members spaced apart in a substantially triangular configuration; at least one of the spaced apart cable guide members suitable to frictionally engage said frictionally engaging cable comprising a continuous loop and connected to a hand crank whereby rotation of the hand crank circulates the cable in a continuous loop.

12. The window regulator of claim 11 wherein a limiting device comprising a spring is provided for limiting the tension.

* * * * *